US008905601B2

(12) United States Patent
Cho et al.

(10) Patent No.: US 8,905,601 B2
(45) Date of Patent: Dec. 9, 2014

(54) LIGHTING APPARATUS HAVING A THERMAL INSULATOR

(75) Inventors: Hankyu Cho, Seoul (KR); Jaehwan Kim, Seoul (KR); Dongki Paik, Seoul (KR)

(73) Assignee: LG Electronics Inc., Seoul (KR)

( * ) Notice: Subject to any disclaimer, the term of this patent is extended or adjusted under 35 U.S.C. 154(b) by 265 days.

(21) Appl. No.: 13/421,202

(22) Filed: Mar. 15, 2012

(65) Prior Publication Data

US 2013/0051035 A1 Feb. 28, 2013

(30) Foreign Application Priority Data

Aug. 31, 2011 (KR) ..... 10-2011-0087905

(51) Int. Cl.

| | |
|---|---|
| ***F21V 29/00*** | (2006.01) |
| ***F21V 15/06*** | (2006.01) |
| ***F21V 3/00*** | (2006.01) |
| ***F21K 99/00*** | (2010.01) |
| ***F21V 23/00*** | (2006.01) |
| *F21Y 101/02* | (2006.01) |
| *F21V 17/10* | (2006.01) |
| *F21Y 111/00* | (2006.01) |

(52) U.S. Cl.

CPC ..... *F21V 23/009* (2013.01); *F21V 15/06* (2013.01); *F21Y 2101/02* (2013.01); *F21V 3/00* (2013.01); *F21K 9/135* (2013.01); *F21V 29/2231* (2013.01); *F21V 17/10* (2013.01); *F21Y 2111/007* (2013.01); *F21V 29/2237* (2013.01)

USPC ..... 362/373; 362/365; 313/46

(58) Field of Classification Search

CPC ... F21K 9/135; F21Y 2101/02; F21V 7/0066; F21V 29/2231; F21V 3/00

USPC ..... 362/249.02, 294, 373, 363–365; 313/46

See application file for complete search history.

(56) References Cited

U.S. PATENT DOCUMENTS

| | | | | |
|---|---|---|---|---|
| 7,226,189 | B2 | 6/2007 | Lee et al. | |
| 7,758,223 | B2 * | 7/2010 | Osawa et al. | 362/547 |
| 8,506,133 | B2 * | 8/2013 | Tomiyoshi et al. | 362/363 |
| 2010/0289396 | A1 * | 11/2010 | Osawa et al. | 313/46 |
| 2011/0156569 | A1 * | 6/2011 | Osawa | 313/46 |
| 2013/0027938 | A1 * | 1/2013 | Hisayasu | 362/249.02 |

FOREIGN PATENT DOCUMENTS

| | | |
|---|---|---|
| JP | 2010-056059 | 3/2010 |
| JP | 2011-146241 | 7/2011 |
| KR | 10-2010-0064800 A | 6/2010 |

OTHER PUBLICATIONS

Korean Notice of Allowance dated Jul. 4, 2013.

* cited by examiner

*Primary Examiner* — Karabi Guharay
(74) *Attorney, Agent, or Firm* — Ked & Associates, LLP

(57) ABSTRACT

A lighting apparatus is disclosed. The lighting apparatus may include a heat sink, an LED module provided on the heat sink, an enclosure provided over the heat sink to surround the LED module, an insulator provided between the heat sink and the enclosure, a power module provided below the heat sink to provide power to the LED module, a housing attached to the heat sink to house the power module, and a power socket mounted to the housing and electrically connected to the electronic module. The heat sink may include a channel formed to correspond to a shape of the enclosure and the insulator may be provided in the channel, the insulator and the enclosure being formed of different materials.

14 Claims, 6 Drawing Sheets

LIGHTING APPARATUS HAVING A THERMAL INSULATOR

CROSS-REFERENCE TO RELATED APPLICATION(S)

This application claims priority under 35 U.S.C. §119 to Korean Application No. 10-2011-0087905 filed in Korea on Aug. 31, 2011, whose entire disclosure is hereby incorporated by reference.

BACKGROUND

1. Field

A lighting apparatus is disclosed herein.

2. Background

Lighting apparatuses are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Figure 1:
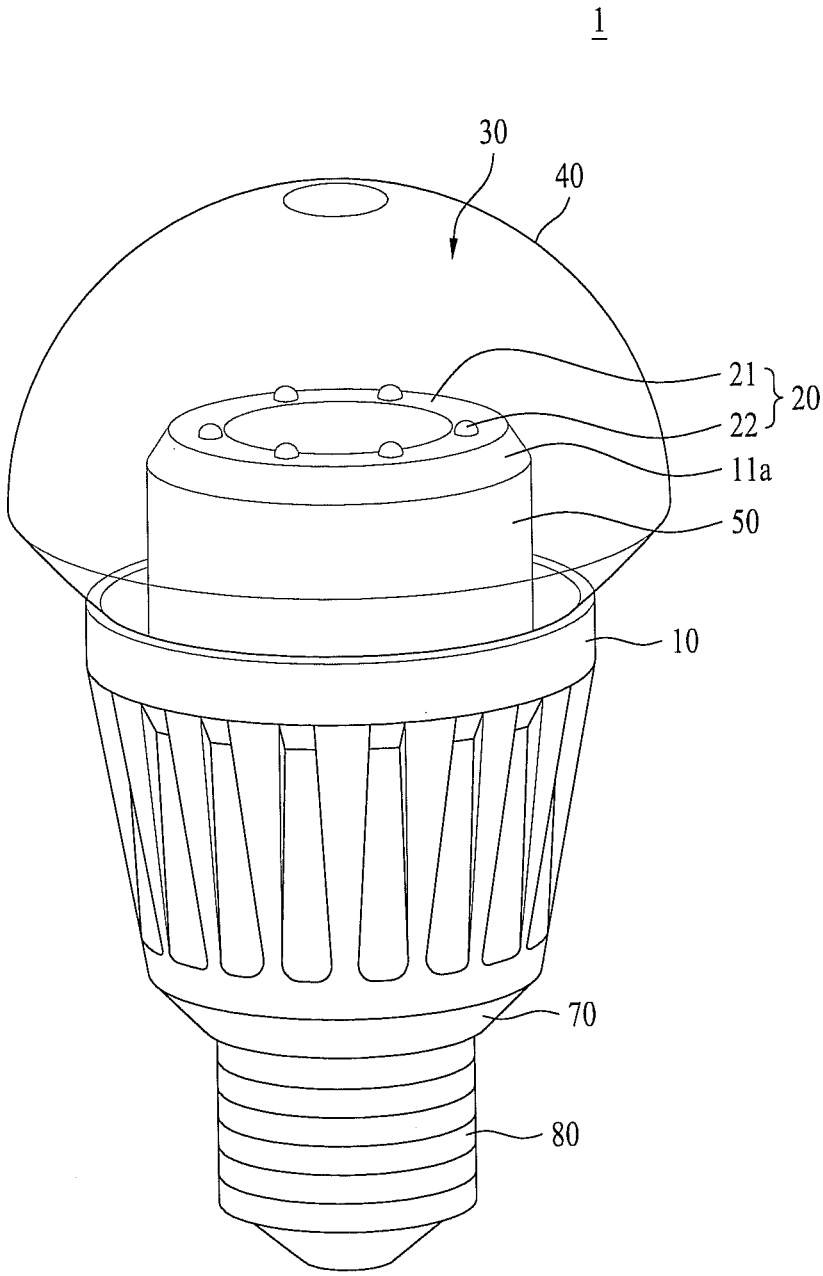
FIG. 1 is a perspective view of a lighting apparatus according to one embodiment of the present disclosure.

Lighting apparatuses may include incandescent bulbs, fluorescent lamps and discharge lamps. These lighting apparatuses may be used for a variety of purposes, such as domestic, industrial, or for outdoor purposes. However, lighting apparatuses operating based upon electrical resistance, such as incandescent bulbs, may have problems of low efficiency and high heat loss. Discharge lamps may be expensive and may exhibit relatively poor energy efficiency. Fluorescent lamps may be harmful to the environment due to the use of mercury.

In contrast, lighting apparatuses which use light emitting diodes (LEDs) may avoid these disadvantages while providing many benefits, such as higher efficiency as well as flexibility in the design of the lighting apparatus (e.g., colors and designs). An LED is a semiconductor device which emits light when a forward voltage is applied thereto. Such an LED exhibits a relatively longer lifespan, lower power consumption, and electrical, optical, and physical characteristics suitable for mass production.

However, LEDs may generate relatively large amounts of heat. This heat may degrade performance of the lighting apparatus if such heat is not sufficiently dissipated through a heat sink, or another appropriate type of cooling device. Moreover, if the heat generated from the LED is transferred to other constituent elements via the heat sink, the constituent elements may overheat or be damaged. The heat may also deform or otherwise damage the bulb if not sufficiently dissipated and is allowed to transfer to the bulb.

Furthermore, LEDs may exhibit degraded light distribution characteristics because of a relatively narrow angular range of light emission, and hence, may not effectively illuminate a large area. For example, a lighting apparatus which employs LEDs may exhibit a high degree of directionality and a narrow radiation angle. For this reason, when an LED based lighting apparatus is installed on a ceiling, for example, only a relatively small region disposed directly beneath the lighting apparatus may be illuminated with sufficient intensity, and areas which are farther away from the light source may not be illuminated with sufficient intensity. Therefore, in order to illuminate a large area with sufficient intensity of illumination, it may be necessary to increase the number of lighting apparatuses, at the expense of increased costs in materials and installation.

Accordingly, the present disclosure is directed to a lighting apparatus that substantially obviates one or more problems due to these limitations and disadvantages. As embodied and broadly described herein, the lighting apparatus may reduce the amount of heat transferred from a heat sink to an enclosure (e.g., bulb). The lighting apparatus may be capable of omnidirectionally radiating light emitted from an LED while maintaining a uniform level of light intensity. The lighting apparatus may illuminate a wider area using light emitted from a light emitting diode (LED). Moreover, the lighting apparatus as disclosed herein may allow a reduction in the number of constituent elements, a reduction in manufacturing costs, and be suitable for mass production.

Reference will now be made in detail to the embodiments of the present disclosure associated with a lighting apparatus, examples of which are illustrated in the accompanying drawings. The accompanying drawings illustrate exemplary embodiments of the present disclosure and provide a more detailed description of the present disclosure. However, the scope of the present disclosure should not be limited thereto.

In addition, wherever possible, the same reference numbers will be used throughout the drawings to refer to the same or like parts, and a repeated description thereof will be omitted. For clarity, dimensions and shapes of respective constituent members illustrated in the drawings may be exaggerated or reduced. Moreover, although terms including an ordinal number, such as first or second, may be used to describe a variety of constituent elements, the constituent elements are not limited to the terms, and the terms are used only for the purpose of discriminating one constituent element from other constituent elements.

Figure 2:
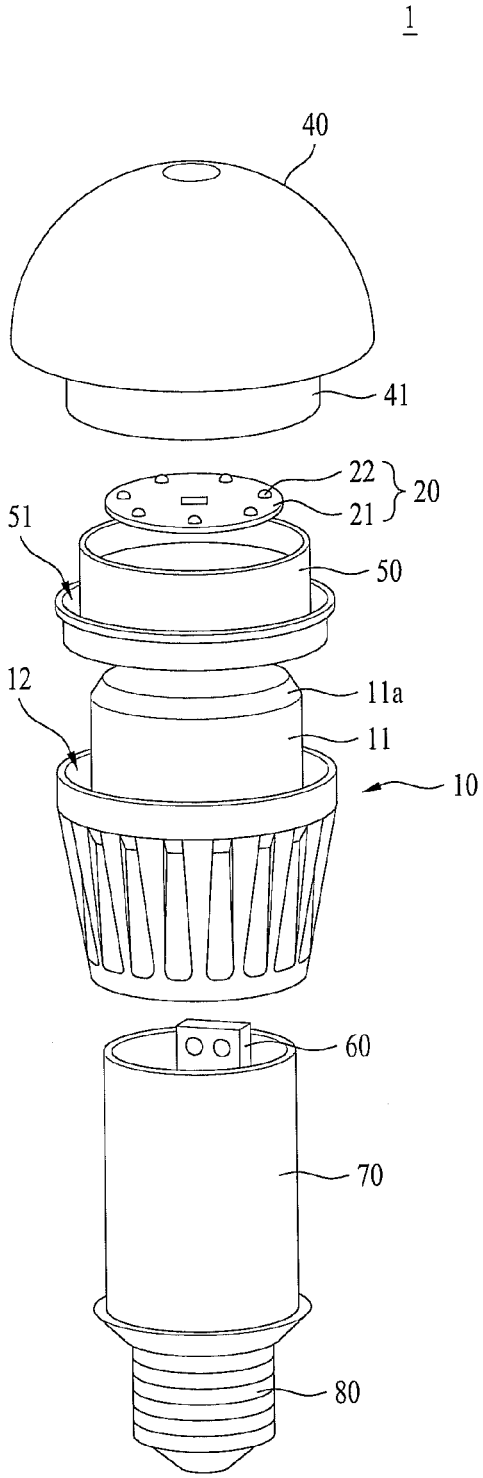
FIG. 2 is an exploded perspective view of the lighting apparatus of FIG. 1.
Figure 3:
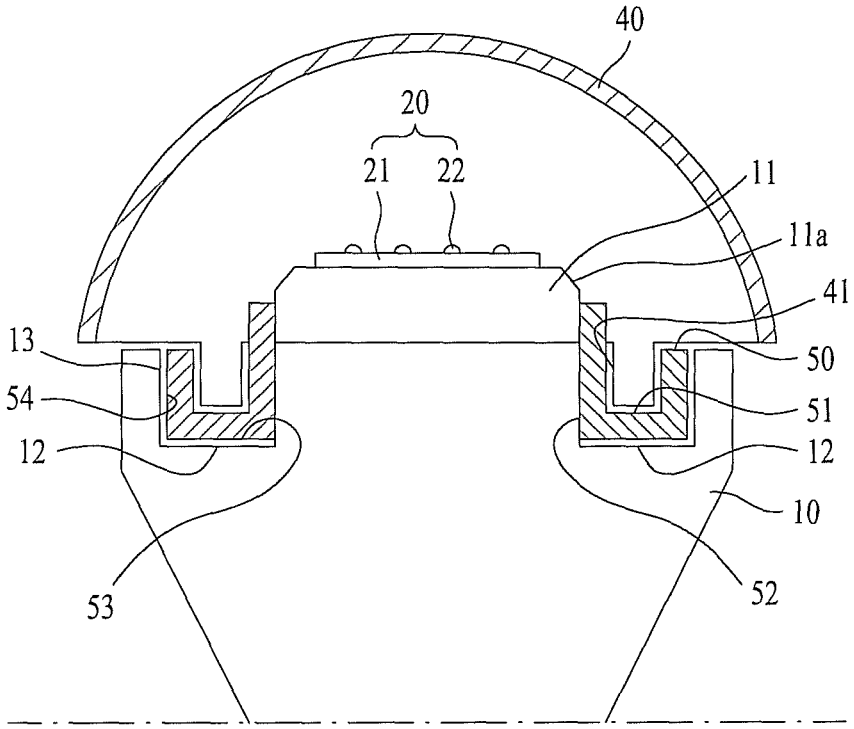
FIG. 3 is a sectional view of the lighting apparatus of FIG. 1.

FIG. 1 is a perspective view of a lighting apparatus according to one embodiment of the present disclosure. FIG. 2 is an exploded perspective view of the lighting apparatus of FIG. 1. FIG. 3 is a sectional view of the lighting apparatus of FIG. 1.

The lighting apparatus 1 may include a light emitting module 20, a heat sink 10, a mounting block 11, and an insulating member 50 (insulator). The lighting apparatus 1 may include an electronic module 60 (power module), a power socket 80, and a housing 70.

The light emitting module 20 may include a substrate 21 and one or more light emitting diodes (LED) 22 mounted on the substrate 21. The light emitting module 20 may also be referred to herein as an LED module. However, it should be appreciated that other types of light sources may be used in the light emitting module 20.

The heat sink 10 may dissipate heat generated by the light emitting module 20. The electronic module 60 is electrically connected to the light emitting module 20. The housing 70 may accommodate or house the electronic module 60. The power socket 80 may be mounted to the housing 70 and electrically connected to the electronic module 60. The bulb 40 may be disposed on the heat sink 10 such that it surrounds the light emitting module 20. The insulator 50 may be interposed between the heat sink 10 and the enclosure 40.

The enclosure 40 may have various shapes, taking into consideration the design of the lighting apparatus 1. For example, the enclosure 40 may have a round or bulbous shape, tubular shape, polygonal shape, or the like. Simply for ease of description, the enclosure 40 will be referred to hereinafter as a bulb.

The bulb 40 may have a function of diffusing light emitted from the light emitting module 20 or adjusting the direction of the light radiated outwardly through the bulb 40. For example, where the bulb 40 functions as a diffuser, it may scatter or diffuse light, so that it may be possible to eliminate the directionality of light from the LEDs 22. In this case, the bulb 40 may have a surface structure over the entire surface thereof to enable the diffusion.

The bulb 40 may be divided into a central region corresponding to a central axis of the heat sink 10, a side region which extends from the central region, and a lower end region which extends from the side region and arranged adjacent to the heat sink 10. The central region, side region, and lower end region may have different curvatures or one or more regions may be linear. A mounting end 41 may be provided at the lower end region of the bulb 40. The bulb 40 may include an opening adjacent to the lower end region. The mounting end 41 may be a flange that protrudes from the opening of the bulb 40 for mounting the bulb 40 onto the lighting apparatus 1. The flange 41 may have a ring shape.

As described above, the electronic module 60 may be disposed within the housing 70. The electronic module 60 may convert commercial power into input power for the light emitting module 20. The housing 70 may provide thermal and electrical insulation between the heat sink 10 and electronic module 60. The power socket 80, which may supply commercial power, may be mounted to the housing 70.

As illustrated in FIG. 2, the housing 70 may be configured separately from the heat sink 10. The housing 70 may be mounted to the heat sink 10 using various types of methods, for example, friction fitting, screws, or threads or tabs formed on the housing 70. In one embodiment, the housing 70 may be formed to be structurally integrated to the heat sink 10.

In one embodiment, the housing 70 may be made of a thermally conductive material, such as metal, in order to dissipate heat from the light emitting module 20 and/or the electronic module 60. Moreover, the housing 70 may be formed of an electrically insulating material to electrically insulate the electronic module 60 from the heat sink 10. Moreover, an insulating material may be deposited in the housing between the housing and the electronic module 60 to insulate the electronic module 60. The electronic module 60 may include various elements, for example, a converter for converting commercial power to DC power, and a transformer for adjusting the voltage level of the DC power.

The heat sink 10 may be made of a thermally conductive material such as metal, to rapidly dissipate heat generated from the light emitting module 20. A plurality of heat radiation fins may be provided on the heat sink 10 to increase the contact surface between the heat sink 10 and ambient air.

The heat sink 10 may include, at a top portion thereof, a mounting portion 11 on which the light emitting module 20 may be mounted. The heat sink 10 may include a recess 12 provided at the top portion of the heat sink 10 to receive the insulator 50. The recess 12 may be a channel and may be positioned around the circumference of the mounting portion 11. The heat sink 10 may further include a cavity formed in the interior of the heat sink 10. The cavity may be opened at the lower end of the heat sink 10 to receive the housing 70.

As described above, the light emitting module 20 may include the substrate 21 disposed on a top surface of the mounting portion 11 of the heat sink 10, and at least one LED 22 mounted on the substrate 21. The LED 22, which may be an LED element, may exhibit a relatively high degree of directionality and a narrow light distribution angle (e.g., about 120°).

Figure 4:
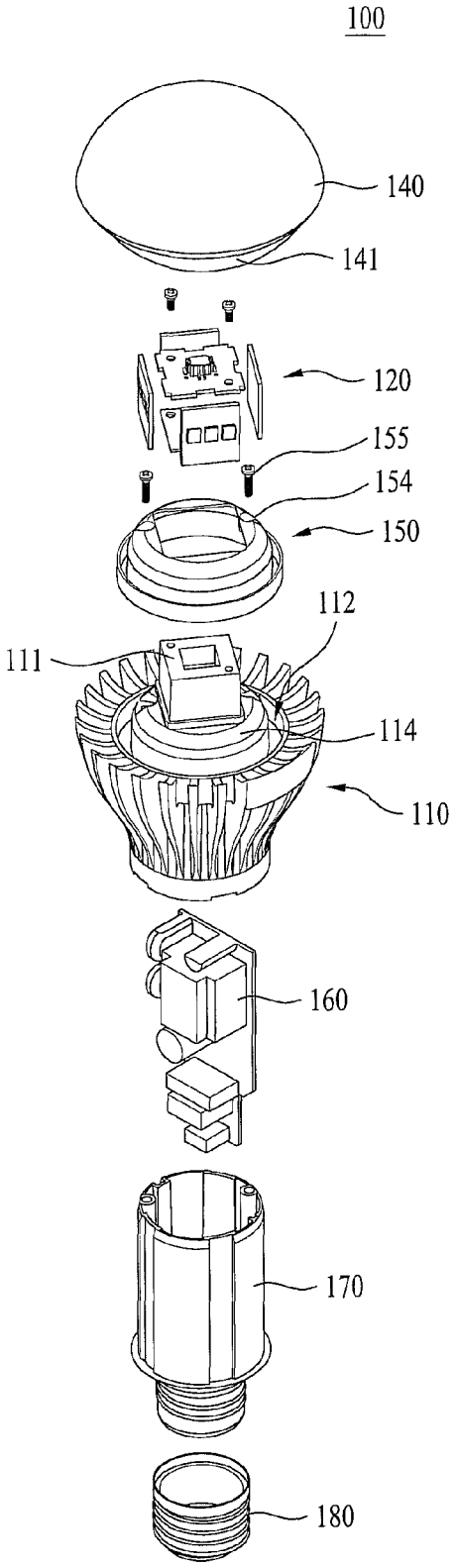
FIG. 4 is an exploded perspective view of a lighting apparatus according to one embodiment of the present disclosure.
Figure 5:
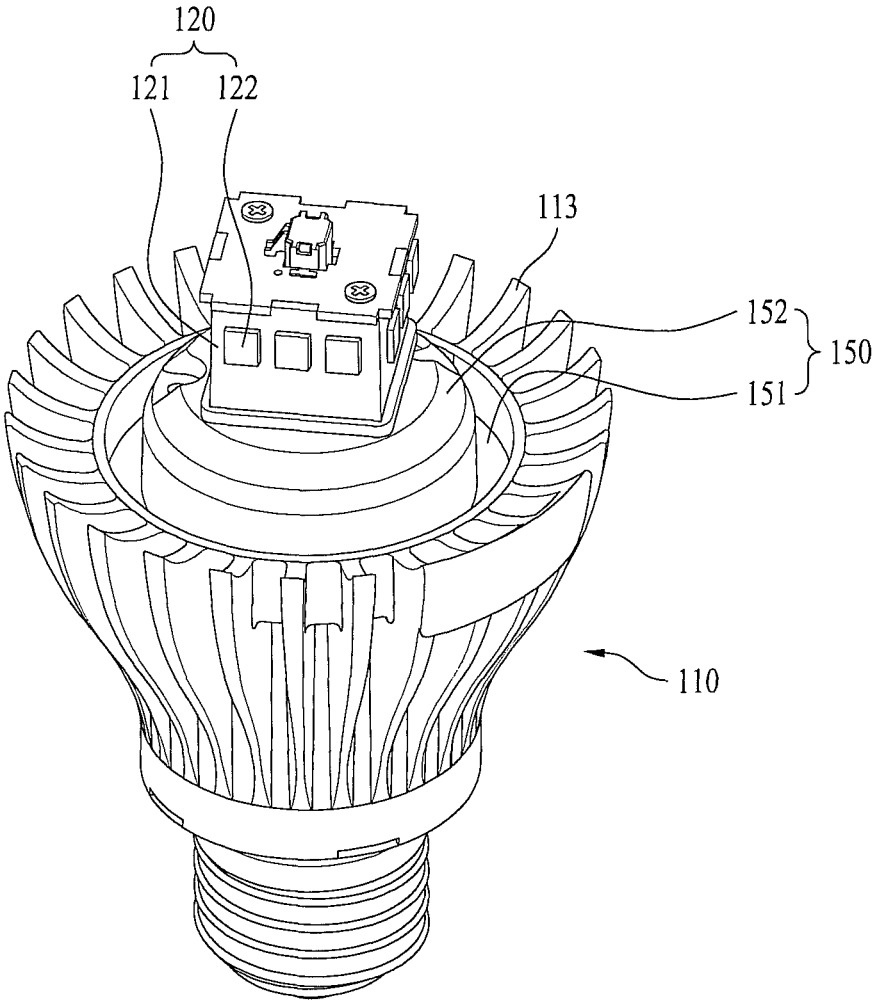
FIG. 5 is a perspective view of the lighting apparatus of FIG. 4.

The light emitting module 20 may be classified into a top view type light emitting module, in which light mainly radiates toward the central region of the bulb 40, as illustrated in FIG. 1, or a side view type light emitting module, in which light mainly radiates toward the side region of the bulb 40, as illustrated in FIG. 4. Where the light emitting module 20 is of a top view type, it may be disposed on the top surface of the mounting portion 11 of the heat sink 10, as shown in FIG. 1. On the other hand, where the light emitting module 20 is of a side view type, it may be mounted to a side surface of the mounting portion 111 of the heat sink 110, as shown in FIGS. 4 and 5.

Meanwhile, the light emitting module 20 may generate a large amount of heat during operation of the lighting apparatus 1. The generated heat may be outwardly dissipated through the heat sink 10. If the bulb 40 is mounted to make direct contact with the heat sink 10, heat generated from the light emitting module 20 may be transferred to the bulb 40 via the heat sink 10. As a result, it may be possible that the bulb 40 is damaged (e.g., deformed) when allowed to be exposed to the high temperatures.

In order to avoid such deformation of the bulb 40, the lighting apparatus 1 may include an insulator 50 which functions to reduce the amount of heat transferred from the heat sink 10 to the bulb 40. The insulator 50 may be interposed between the heat sink 11 and the bulb 40 to physically separate the heat sink 10 and bulb 40 from each other, and thus, to prevent the heat sink 10 and bulb 40 from directly contacting each other.

Referring to FIGS. 2 and 3, an exemplary configuration of the heat sink 10 is shown. As described above, the heat sink 10 may include the mounting portion 11 which is provided at the top portion of the heat sink 10. The mounting portion 11 may have one of a variety of shapes, such as a round column or pillar or a polygonal protrusion having multiple flat side surfaces. The light emitting module 20 may be mounted on the mounting portion 11. The heat sink 10 may include a recess 12, which is provided at the top portion of the heat sink 10 to receive the insulator 50. The heat sink 10 may further include a cavity formed in the interior of the heat sink 10 and opened to a lower end of the heat sink 10, to receive the housing 70.

The insulator 50 may have a structure for spacing the heat sink 10 and bulb 40 from each other. For example, the insulator 50 may include a ring portion 52 that surrounds at least a part of the mounting portion 11, and a fitting groove portion 51 (groove or channel) formed around a circumferential surface of the ring portion 51 that receives the flange 41 of the bulb 40.

The ring portion 52 of the insulator 50 may be shaped to correspond to the shape of the side surface of the mounting portion 11. The fitting groove portion 51 may correspond to the shape of the recess 12. The bottom surface 53 of the insulator 50 may contact the heat sink 10 in the recess 12.

In one embodiment, a prescribed gap may be formed between the insulator 50 and the heat sink 10 inside the recess 12 in order to improve thermal insulation. That is, the insulator 50 may be formed such that the bottom surface 53 and the outer side surface 54 of the insulator 50 do not physically contact the corresponding surfaces of the heat sink 10 in the recess 12.

The insulator 50 may be mounted to the mounting portion using various methods such as friction fitting, connectors, screws, adhesives, or the like. In order to provide the prescribed gap between the bottom surface of the insulator 50 and the heat sink 10, one or more protrusion may be provided on the bottom surface of the recess 12. The height of the protrusions may correspond to the amount of gap desired between the insulator 50 and the heat sink 10. Moreover, the width of the insulator 50 may be such that a desired gap is provided between the outer side surface 54 of the insulator 50 and the inner side surface 13 of the recess 12.

The insulator 50 may be provided with a reflection layer at a surface thereof. The reflection layer may reflect light emitted from the light emitting module 20 over the omnidirectional region of the bulb 40. The reflection layer may be a reflective coating, tape, film, sheet or the like. In one embodiment, the insulator 50 may be formed of a reflective material.

The bulb 40 may be coupled to the lighting apparatus 1 using a protrusion and groove formed on the bulb 40 and the insulator 50. For example, a protrusion may be provided on the bulb 40 and a corresponding groove may be provided at the fitting groove portion 51 to connect to the protrusion of the bulb 40. Alternatively, the protrusion may be formed on the fitting groove portion 12 and the corresponding groove may be formed on the bulb 40. Accordingly, the bulb 40 and fitting groove portion 51 may be coupled in a fitted state without using separate fasteners. In one example, a protrusion may be provided on the flange 41 of the bulb 40, and a corresponding groove to be engaged with the protrusion may be provided at the inner circumferential surface of the fitting groove portion 51.

The protrusion and groove for connecting the bulb 40 may extend circumferentially around the respective surfaces of the flange 41 of the bulb and the fitting groove portion 51 of the insulator 50 as a single structure. Alternatively, one or more pairs of protrusion and groove may be placed at prescribed distances along the flange 41 and the fitting groove portion 51.

In one embodiment, the flange 41 may be formed as a plurality of tabs rather than having a ring shape. The use of tabs rather than a ring shaped flange 41 may reduce heat transfer to the bulb 40 by reducing the contact surface of the bulb 140. In this case, one or more of the plurality of tabs may include the protrusion or groove to fit a corresponding protrusion or groove on the insulator 50.

As the insulator 50 may be fastened directly on the heat sink 10, the insulator 50 may be made of a material having excellent heat resistance to reduce heat transfer. On the other hand, the insulator 50 may be made of a material having low thermal conductivity in order to reduce the amount of heat transferred from the heat sink 10 to the bulb 40. The insulator 50 may be formed of a material that is different than the bulb 40. The insulator 50 may be pliable and the bulb 40 may be not pliable. It should be appreciated that the insulator 50 may be formed of various thermal conductivity values as well as rigidity based on the desired amount of insulation and fitment. Moreover, the insulator 50 may have a lower thermal conductivity than the bulb 40.

In one embodiment, a thermal insulator may be provided in the fitting groove portion 51 between the insulator 50 and the flange 41 to further prevent heat transfer to the bulb 40. The thermal insulator may be formed of a pliable material or a rigid material formed to correspond to the fitting groove portion 51 or the recess 12. The thermal insulator may have lower thermal conductivity than the bulb 40. The thermal insulator may be a coating, tape, film, sheet, or another appropriate type of material formed on the flange 41 of the bulb 40. In one embodiment, the flange 41 of the bulb may be formed of a different material than the body of the bulb 40. For example, the flange 41 may be formed on a material having a lower thermal conductivity than the remaining portions of the bulb 140. The thermal insulator may also be provided between the fitting groove portion 51 and the heat sink 10 at the recess 12.

Moreover, the insulator 50 may be made of a material having high reflectivity in order to reflect light emitted from the light emitting module 20 over the omnidirectional region of the bulb 40. The heat sink 10 may further include an inclined portion 11*a* circumferentially formed at an upper end of the mounting portion 11. The inclined portion 11*a* may reflect light emitted from the light emitting module 20 over the omnidirectional region of the bulb 40 and may prevent obstruction of light by the mounting portion 11.

Figure 6:
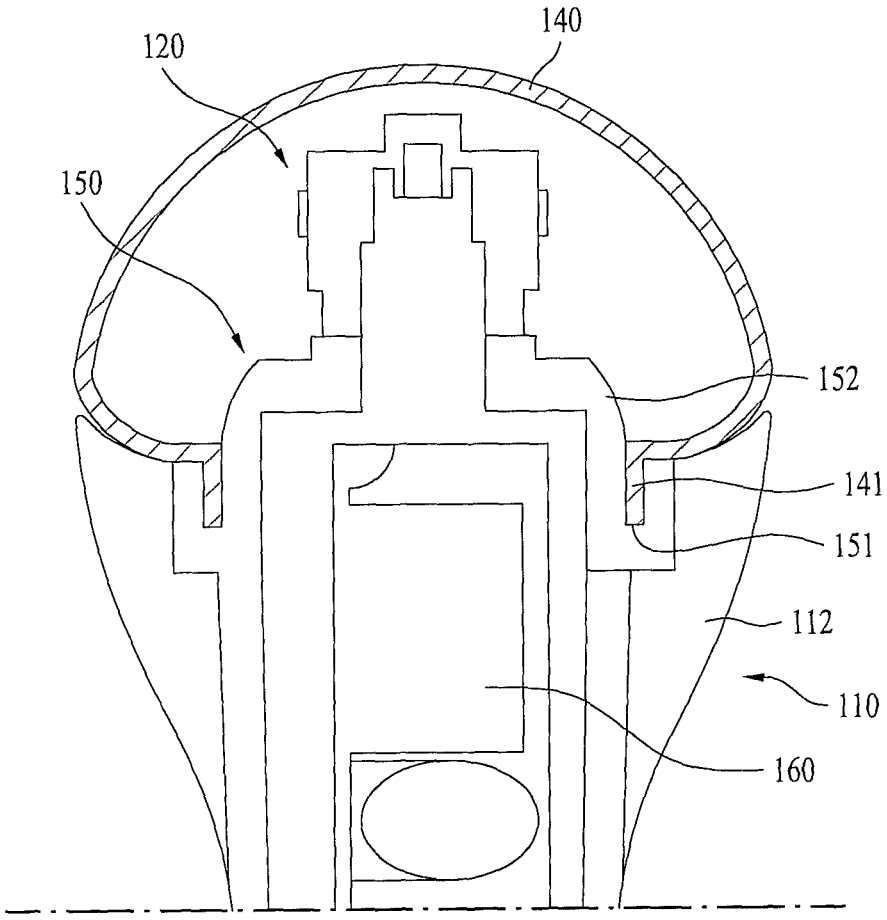
FIG. 6 is a sectional view of the lighting apparatus of FIG. 4.

FIG. 4 is an exploded perspective view of a lighting apparatus according to another embodiment of the present disclosure. FIG. 5 is a perspective view of the lighting apparatus of FIG. 4. FIG. 6 is a sectional view of the lighting apparatus of FIG. 4.

The lighting apparatus 100 may include an enclosure 140 having a mounting end 141 (e.g., flange), a light emitting module 120 (e.g., LED module), a heat sink 110, an insulator 150, an electronic module 160, a housing 170, and a power socket 180. The lighting apparatus 100 of this embodiment includes features which are the same or similar to the features of the lighting apparatus 1 of FIG. 1 as previously described. Accordingly, repetitive description of common features are omitted hereinafter.

The light emitting module 120 of this embodiment may be a side view type as shown in FIG. 4. The light emitting module 120 may be mounted to a side surface of a mounting portion 111 of the heat sink 110. The mounting portion 111 may have a polygonal column shape. It should be appreciated that the mounting portion 111 may be formed to have various shapes, such as a cylindrical column shape, such that the light emitting module 120 may be mounted to emit light in a lateral direction.

The light emitting module 120 may include a substrate 121 which may be mounted to one side surface of the mounting portion 111, and at least one LED 122 mounted on the substrate 121. A heat transfer pad may be interposed between the substrate 121 and the mounting portion 111 of the heat sink 110. The heat transfer pad may be made of a material having excellent thermal conductivity. The heat transfer pad may improve the transfer of heat generated from the light emitting module 120 to the heat sink 110.

A plurality of heat radiation fins 113 may be provided on the body of the heat sink 110. A mounting portion 111, on which the light emitting module 120 may be mounted, may be provided at a top portion of the body. A recess 112 may be provided in a space defined between the mounting portion 111 and the heat radiation fins 113. The recess 112 may be shaped to correspond to the shape of the insulator to receive the insulator 150. A cavity may be formed in the interior of the body of the heat sink 110 and opened at a lower end of the body to receive the housing 170.

The insulator 150 may include a ring portion 152 that surrounds at least a part of the mounting portion 111, and a fitting groove portion 151 formed around a circumferential surface of the ring portion 152 to receive the flange 141 of the bulb 140. The fitting groove portion 151 of the insulator 150 may be fitted in the recess 112 of the heat sink 110. The fitting groove portion 151 may be shaped to correspond to the recess 112. The fitting groove portion of the insulator 150 may cover the exposed surfaces of the recess 112 such that the bulb 140 does not contact the heat sink 110 in order to thermally insulate the bulb 140. In one embodiment, the fitting groove portion 151 may be formed such that the bottom surface of the insulator 150 does not physically contact the surface of the heat sink 110. Hence, the contact area between the insulator 150 and the heat sink 110 may be reduced, thereby improving thermal insulation of the bulb 140.

The bulb 140 may be mounted on the insulator 150 using various types of connections, such as friction fitting, hook and groove, adhesives, or the like. For example, a protrusion may be provided on the flange 141 of the bulb 140 and a corresponding groove/notch may be provided on the fitting groove portion 151 to mate with the protrusion. It should be appreciated that the positions of the protrusion and the groove may be reversed. The insulator 150 may be mounted to the heat sink 110 using various types of connections, such as friction fitting, hook and groove, adhesives, or the like. For example, the insulator 150 may be mounted to the heat sink 110 using screws 155 placed through holes 154 on the insulator 150, as illustrated in FIG. 4.

The insulator 150 may be a reflector. The insulator 150 may be provided with a reflection layer at a surface thereof. Alternatively, the insulator 150 may be formed of a reflective material. The insulator 150 may reflect light emitted from the light emitting module 20 over the omnidirectional region of the bulb 140.

Meanwhile, the mounting portion 111 of the heat sink 110 may include an inclined portion 114. The inclined portion 114 may be configured to slope toward the fitting groove portion 151 of the bulb 140. The ring portion 152 of the insulator 150, which surrounds the inclined portion 114, may have the same angle of incline as the inclined portion 114.

For example, the LED 122 may have a light distribution angle of about 120°. Where the light emitting module 120 is of a side view type, the insulator 150 may interfere with light emitted from the light emitting module 120 at a particular light distribution angle. To this end, the ring portion 152 of the insulator 150 may be downwardly inclined toward the heat sink 110 to prevent interference with the light. Moreover, the inclined portion 114 of the mounting portion 111 may be formed to correspond to the inclination of the ring portion 152 of the insulator 150.

The lighting apparatus 100 may be an omni-directional light source that provides omni-directional light distribution. Omni-directional light distribution as referred to herein may include distribution of light having a minimum light velocity (luminous flux) of 5% or more at a light distribution angle of 135° or more, and having an average light velocity difference (luminous flux deviation) of 20% or less at a predetermined light distribution angle in a range of 0° to 135°. In other words, luminous intensity (candelas) of the lighting apparatus 1 may be evenly distributed in a zone or angular range within 0° to 135°, measured from an optical center of the lighting apparatus. This light distribution zone may be vertically axially symmetrical. At least 5% of total flux (lumens) may be emitted in the zone within 135° to 180°. Moreover, luminous intensity at any angle within the 0° to 135° zone may not differ from the mean luminous intensity for the entire zone by more than 20%.

In this embodiment, light emitted from the LED 122 may be reflected toward the side region and lower end region of the bulb 140. Through use of the side view type light emitting module 120 and the insulator 150, which includes the inclined portion and the reflection layer, the omni-directional light distribution requirement may be satisfied.

As apparent from the above description, the lighting apparatus according to one of the illustrated embodiments of the present disclosure may reduce the amount of heat transferred from the heat sink to the bulb. The lighting apparatus may also radiate light emitted from the in a uniform amount over the omnidirectional region of the bulb. Moreover, the lighting apparatus may enable a reduction in the number of constituent elements, a reduction in manufacturing costs, and facilitation of mass production.

As embodied and broadly described herein, a lighting apparatus may include a light emitting module including a substrate and a light emitting diode (LED) mounted on the substrate, a heat sink for dissipating heat from the light emitting module, an electronic module electrically connected to the light emitting module, a housing for receiving the electronic module, a power socket mounted to the housing and electrically connected to the electronic module, a bulb disposed on the heat sink while surrounding the light emitting module, and an insulating member interposed between the heat sink and the bulb to reduce an amount of heat transferred from the heat sink to the bulb.

The heat sink may include a mounting portion, on which the light emitting module is mounted, the mounting portion being provided at a top portion of the heat sink, a recess provided at the top portion of the heat sink to receive the insulating member, and a cavity formed in an interior of the heat sink and opened to a lower end of the heat sink to receive the housing.

The insulating member may include a ring portion for surrounding at least a part of the mounting portion, and a fitting groove portion formed around a circumferential surface of the ring portion, to receive a portion of the bulb. The insulating member may be fitted in the recess. Moreover, the insulating member may include a reflection layer provided at a surface of the insulating member. One of the bulb and the fitting groove portion may be provided with a protrusion, and the other of the bulb and the fitting groove portion may be provided with a groove, in which the protrusion is fitted.

The heat sink may include a body having a plurality of heat radiation fins, a mounting portion on which the light emitting module is mounted, the mounting portion being provided at a top portion of the heat sink, a recess provided at the top portion of the heat sink to receive the insulating member, and a cavity formed in an interior of the heat sink and opened to a lower end of the heat sink to receive the housing.

The insulating member may include a ring portion for surrounding at least a part of the mounting portion, and a fitting groove portion formed around a circumferential surface of the ring portion, to receive a portion of the bulb. The insulating member may further include a reflection layer provided at a surface of the insulating member. One of the bulb and the fitting groove portion may be provided with a protrusion, and the other of the bulb and the fitting groove portion may be provided with a groove, in which the protrusion is fitted.

The mounting portion may have an inclined portion which is inclined toward the fitting groove portion of the bulb. The insulating member may have a portion that surrounds the inclined portion while having an angle of inclination equal to an angle of inclination of the inclined portion.

As broadly described and embodied herein, a lighting apparatus may include a heat sink, an LED module provided on the heat sink, an enclosure provided over the heat sink to surround the LED module, an insulator provided between the heat sink and the enclosure, a power module provided below the heat sink to provide power to the LED module, a housing attached to the heat sink to house the power module, and a power socket mounted to the housing and electrically connected to the electronic module. The heat sink includes a channel formed to correspond to a shape of the enclosure and the insulator is provided in the channel, the insulator and the enclosure being formed of different materials.

The insulator may be pliable and the enclosure may be not pliable. The insulator may have a lower thermal conductivity than the enclosure. Moreover, the lighting apparatus may include a reflector provided over a surface of the heat sink. The insulator may be formed along an outer circumference of the reflector. Moreover, the insulator and the reflector form a single structure.

The enclosure may include a flange formed at an opening of the enclosure, the flange is placed over the insulator in the channel. The insulator may include a channel formed to corresponding to the channel on the heat sink. The enclosure may be mounted in the channel on the insulator. Moreover, a gap may be provided between the insulator and the heat sink inside the channel.

The heat sink may include a protrusion formed on an upper surface of the heat sink for mounting the LED module, the channel being formed around the protrusion. The insulator may include a ring portion that surrounds a portion of the protrusion and a channel formed around a circumference of the ring portion to correspond to a flange on the enclosure. The channel of the insulator may be placed in the channel of the heat sink. The insulator may include a reflective material provided on the insulator. The flange may have a protrusion and the channel of the insulator has a corresponding groove for attaching the enclosure to the insulator.

The heat sink may include a body, a plurality of fins provided on the body, a mounting portion provided at an upper region of the body for mounting the LED module, and a cavity formed in lower region of the body to receive the housing. The insulator may include a channel for mounting the enclosure, and the channel of the insulator may surround a side surface of the mounting portion. The insulator may include a reflection layer provided over a surface of the insulator. The channel of the insulator may include a protrusion and the enclosure includes a groove to mate with the protrusion of the channel. Moreover, the mounting portion may include an inclined surface which is inclined toward the channel of the heat sink, and the insulator may include an inclined surface shaped to correspond to the inclined surface of the mounting portion and inclined at the same angle.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:
- a heat sink;
- an LED module provided on the heat sink;
- an enclosure provided over the heat sink to surround the LED module;
- an insulator provided between the heat sink and the enclosure;
- a power module provided below the heat sink to provide power to the LED module;
- a housing attached to the heat sink to house the power module; and
- a power socket mounted to the housing and electrically connected to the power module,
- wherein the heat sink includes a channel formed to correspond to a shape of the enclosure and the insulator is provided in the channel, the insulator and the enclosure being formed of different materials,
- wherein the insulator includes a reflective material provided on the insulator,
- wherein the insulator includes a channel formed to correspond to the channel on the heat sink,
- wherein and the enclosure is mounted in the channel on the insulator, and
- wherein a gap is provided between the insulator and the heat sink inside the channel of the heat sink.

2. The lighting apparatus of claim 1, wherein the insulator is pliable and the enclosure is not pliable.

3. The lighting apparatus of claim 1, wherein the insulator has a lower thermal conductivity than the enclosure.

4. The lighting apparatus of claim 1, wherein the lighting apparatus includes a reflector provided over a surface of the heat sink.

5. The lighting apparatus of claim 4, wherein the insulator is formed along an outer circumference of the reflector.

6. The lighting apparatus of claim 4, wherein the insulator and the reflector form a single structure.

7. The lighting apparatus of claim 1, wherein the enclosure includes a flange formed at an opening of the enclosure, the flange is placed over the insulator in the channel of the heat sink.

8. The lighting apparatus of claim 1, wherein the heat sink includes a protrusion formed on an upper surface of the heat sink for mounting the LED module, the channel of the heat sink being formed around the protrusion.

9. The lighting apparatus according to claim 8, wherein the insulator includes a ring portion that surrounds a portion of the protrusion and the channel of the heat sink is formed around a circumference of the ring portion to correspond to a flange on the enclosure.

10. The lighting apparatus according to claim 9, wherein the flange has a protrusion and the channel of the insulator has a corresponding groove for attaching the enclosure to the insulator.

11. The lighting apparatus according to claim 8, wherein the channel of the insulator is placed in the channel of the heat sink.

12. A lighting apparatus comprising:
- a heat sink;
- an LED module provided on the heat sink;
- an enclosure provided over the heat sink to surround the LED module;
- an insulator provided between the heat sink and the enclosure;

a power module provided below the heat sink to provide power to the LED module;

a housing attached to the heat sink to house the power module; and a power socket mounted to the housing and electrically connected to the power module, wherein the heat sink includes a channel formed to correspond to a shape of the enclosure and the insulator is provided in the channel, the insulator and the enclosure being formed of different materials, wherein the heat sink includes a body;

a plurality of fins provided on the body;

a mounting portion provided at an upper region of the body for mounting the LED module; and a cavity formed in lower region of the body to receive the housing, wherein the insulator includes a channel for mounting the enclosure, and wherein the channel of the insulator surrounds a side surface of the mounting portion, and wherein the channel of the insulator includes a protrusion and the enclosure includes a groove to mate with the protrusion of the channel.

13. The lighting apparatus according to claim 12, wherein the insulator includes a reflection layer provided over a surface of the insulator.

14. The lighting apparatus according to claim 12, wherein the mounting portion has an inclined surface which is inclined toward the channel of the heat sink, and the insulator has an inclined surface shaped to correspond to the inclined surface of the mounting portion and inclined at the same angle.

* * * * *